US008646772B2

(12) United States Patent
Fuda

(10) Patent No.: US 8,646,772 B2
(45) Date of Patent: Feb. 11, 2014

(54) SHEET FEEDER AND IMAGE FORMING SYSTEM

(75) Inventor: Munehisa Fuda, Miyagi (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/604,238

(22) Filed: Sep. 5, 2012

(65) Prior Publication Data

US 2013/0062827 A1 Mar. 14, 2013

(30) Foreign Application Priority Data

Sep. 8, 2011 (JP) ..... 2011-195911

(51) Int. Cl.
*B65H 1/00* (2006.01)

(52) U.S. Cl.
USPC ..... 271/171; 271/145

(58) Field of Classification Search
USPC ..... 271/171, 221, 223, 145, 248
See application file for complete search history.

(56) References Cited

U.S. PATENT DOCUMENTS 6,254,086 B1 7/2001 Sunou et al.
2010/0052246 A1* 3/2010 Sing ..... 271/171

FOREIGN PATENT DOCUMENTS

JP 02276728 A * 11/1990
JP 2001-019173 1/2001
JP 2006-021864 1/2006
JP 3906886 1/2007
JP 4241528 1/2009

* cited by examiner

*Primary Examiner* — Prasad Gokhale
(74) *Attorney, Agent, or Firm* — Harness, Dickey & Pierce, P.L.C.

(57) ABSTRACT

A sheet feeder is disclosed for feeding sheets from a stack by one sheet in a sheet feeding direction, the one sheet being an uppermost sheet of the sheet stack. The sheet feeder includes: a sheet stacker for accommodating the sheet stack therein; a side fence to regulate side ends of the sheets and movable in a direction perpendicular to the sheet feeding direction; a slide shaft arranged in the side fence and extending in a vertical direction; a link member that swings as the side fence moves, a first end of the link member configured to be slidable along the slide shaft, and a second end of the link member configured to be pivotable about a pivot point, which is arranged on a side wall of the sheet stacker at a position lower than the first end; and a swing stopper unit that stops swing of the link member.

8 Claims, 13 Drawing Sheets

LOCKED STATE

UNLOCKED STATE

SHEET FEEDER AND IMAGE FORMING SYSTEM

CROSS-REFERENCE TO RELATED APPLICATIONS

The present application claims priority to and incorporates by reference the entire contents of Japanese Patent Application No. 2011-195911 filed in Japan on Sep. 8, 2011.

BACKGROUND OF THE INVENTION

1. Field of the Invention

The present invention relates to an image forming system such as an electrophotographic copier, printer, facsimile, or an inkjet printer and a sheet feeder installed in the image forming system to feed a recording sheet.

2. Description of the Related Art

In an image forming system such as a copier, a sheet feeder such as a sheet stacker that loads therein paper, onto which an image formed on an image carrier (e.g., a photosensitive element) is to be transferred and fixed, is typically configured to be adjustable to diverse sheet sizes.

Such a sheet feeder typically includes a side fence for regulating side ends of sheets to inside the fence. The side fence is typically slidable to be adjusted to the width of loaded sheets.

Among such sheet feeders, a sheet feeder having a large sheet loading capacity of, e.g., 2,000 sheets or more, includes a paper loading section that is high enough to load such a large number of sheets therein. The height of the side fence that regulates side ends of the sheets to inside the fence of this sheet feeder also depends on the number of sheets of the maximum loading capacity.

The side fence is arranged at each of opposite side ends of the sheets. A rack is attached to a bottom end of the side fence, and a pinion to be meshed with the rack is provided. When one of the side fences is caused to slide, rack-and-pinion gearing causes the other side fence to also slid. The side fences position the sheets by sandwiching the sheets therebetween from the opposite side ends in this way.

Each of the side fences further includes a guide member that guides a sliding direction of the side fence.

A technique related to this type of sheet feeder is disclosed in Japanese Patent No. 3906886, for example. According to this technique, as illustrated in FIG. 16, a bracket 102 is arranged on a top portion of a side fence 101 and moves in synchronization with the side fence 101. Thumbscrews 104 that fasten the bracket 102 and a sheet stacker 103 are tightened to lock the side fence 101 at a desired position.

Another technique related to this type of sheet feeder is disclosed in Japanese Patent No. 4241528, for example. According to this technique, as illustrated in FIG. 17, guide shafts 205 arranged in bottom portions of side fences 201 and fixed to a sheet stacker 203 are locked with a scheme that uses locking couplings (not shown) that are attached to the side fences 201 so that the side fences 201 are locked at desired positions.

However, the technique disclosed in Japanese Patent No. 3906886 requires a user, when loading sheets, to remove a plurality of thumb screws attached to the side fences, adjust the side fences to side ends of the sheets, and then refasten the plurality of thumb screws. Accordingly, this technique is disadvantageously less convenient because it involves the trouble of refastening the thumb screws.

According to the technique disclosed in Japanese Patent No. 4241528, the side fences are fixed at basal end portions of the side fences. Accordingly, the side fences are not fixed at their top portions. When the side fences possess low rigidity, a clearance between the side fence and a sheet can be undesirably created at a position near a top surface of a sheet stack from which a sheet is to be delivered. This can result in skewing of the sheet during sheet feeding or the like.

Therefore, there is a need to provide a sheet feeder that can properly regulate side ends of sheets to within a given range.

SUMMARY OF THE INVENTION

It is an object of the present invention to at least partially solve the problems in the conventional technology.

According to an aspect of the present invention, there is provided a sheet feeder for feeding sheets from a sheet stack containing a plurality of sheets one sheet by one sheet in a sheet feeding direction, the one sheet being an uppermost sheet of the sheet stack, the sheet feeder including: a sheet stacker for accommodating the sheet stack therein; a side fence arranged inside the sheet stacker to regulate side ends of the sheets and movable in a direction perpendicular to the sheet feeding direction; a slide shaft arranged in the side fence and extending in a vertical direction; a link member that swings as the side fence moves, a first end of the link member configured to be slidable along the slide shaft, and a second end of the link member configured to be pivotable about a pivot point, which is arranged on a side wall of the sheet stacker at a position lower than the first end; and a swing stopper unit that stops swing of the link member.

According to another aspect of the present invention, there is provided an image forming system including a sheet feeder for feeding sheets from a sheet stack containing a plurality of sheets one sheet by one sheet in a sheet feeding direction, the one sheet being an uppermost sheet of the sheet stack, the sheet feeder including: a sheet stacker for accommodating the sheet stack therein; a side fence arranged inside the sheet stacker to regulate side ends of the sheets and movable in a direction perpendicular to the sheet feeding direction; a slide shaft arranged in the side fence and extending in a vertical direction; a link member that swings as the side fence moves, a first end of the link member configured to be slidable along the slide shaft, and a second end of the link member configured to be pivotable about a pivot point, which is arranged on a side wall of the sheet stacker at a position lower than the first end; and a swing stopper unit that stops swing of the link member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments are described below with reference to the accompanying drawings.

Configurations are described first.

Figure 1:
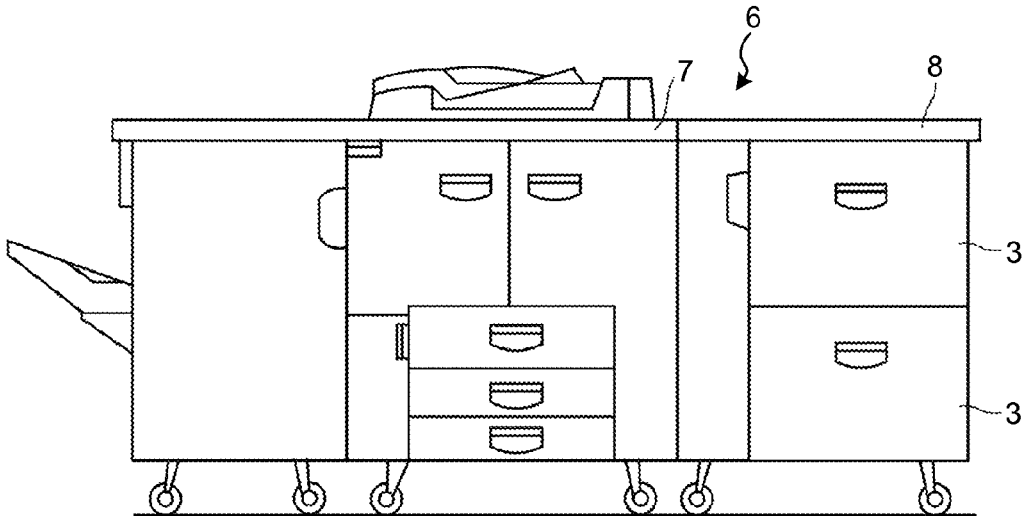
FIG. 1 is a schematic configuration diagram of an image forming system that includes a sheet feeder according to an embodiment.

As illustrated in FIG. 1, an image forming system 6 includes an image forming apparatus body 7 and a sheet feeder 8 connected to one side surface of the image forming apparatus body 7. The sheet feeder 8 includes a sheet stacker 3 that accommodates a sheet stack containing a plurality of sheets (recording sheets) and is configured to feed the sheets one sheet by one sheet, which is an uppermost sheet of the sheet stack, to the image forming apparatus body 7. In the present embodiment, the sheet feeder 8 includes two units of the sheet stacker 3.

Figure 2:
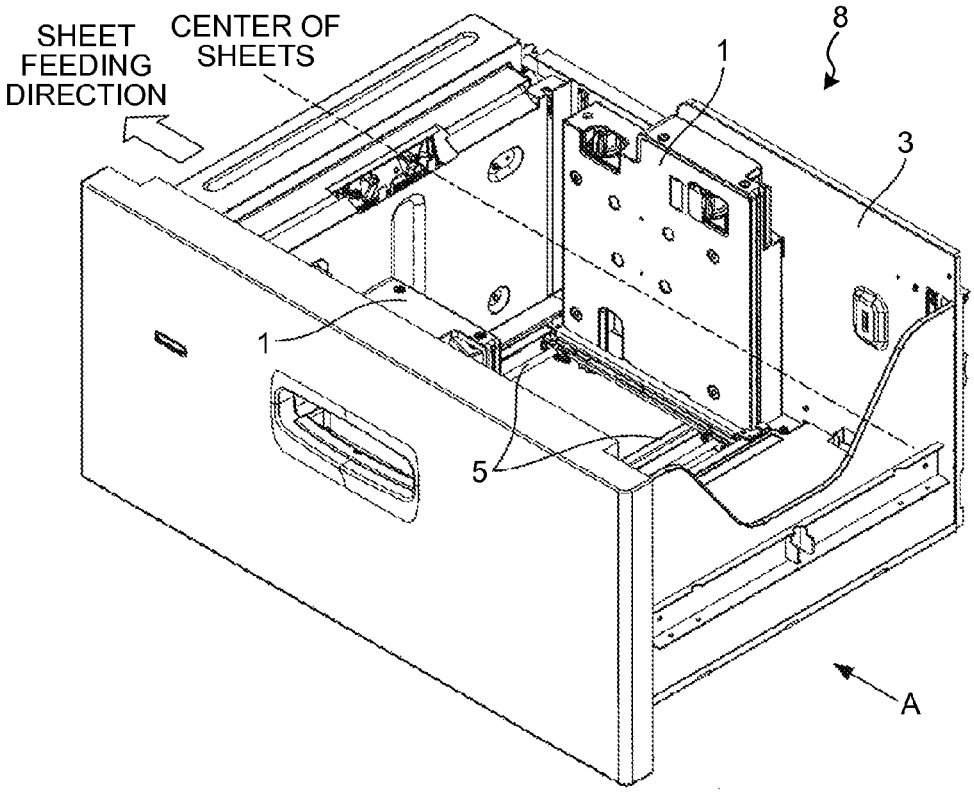
FIG. 2 is a perspective view of the sheet feeder according to the embodiment.

A first feature is described below. As illustrated in FIG. 2, side fences 1 are placed upright inside the sheet stacker 3 of the sheet feeder 8. Guide shafts 5 that are fixed to the sheet stacker 3 extend through bottom portions of the side fences 1. The side fences 1 regulate side ends of the sheets to inside the side fences 1. The side fences 1 are movable by being guided along the guide shafts 5 in a direction (sheet width direction) perpendicular to a sheet feeding direction with respect to the loaded sheets.

Figure 3:
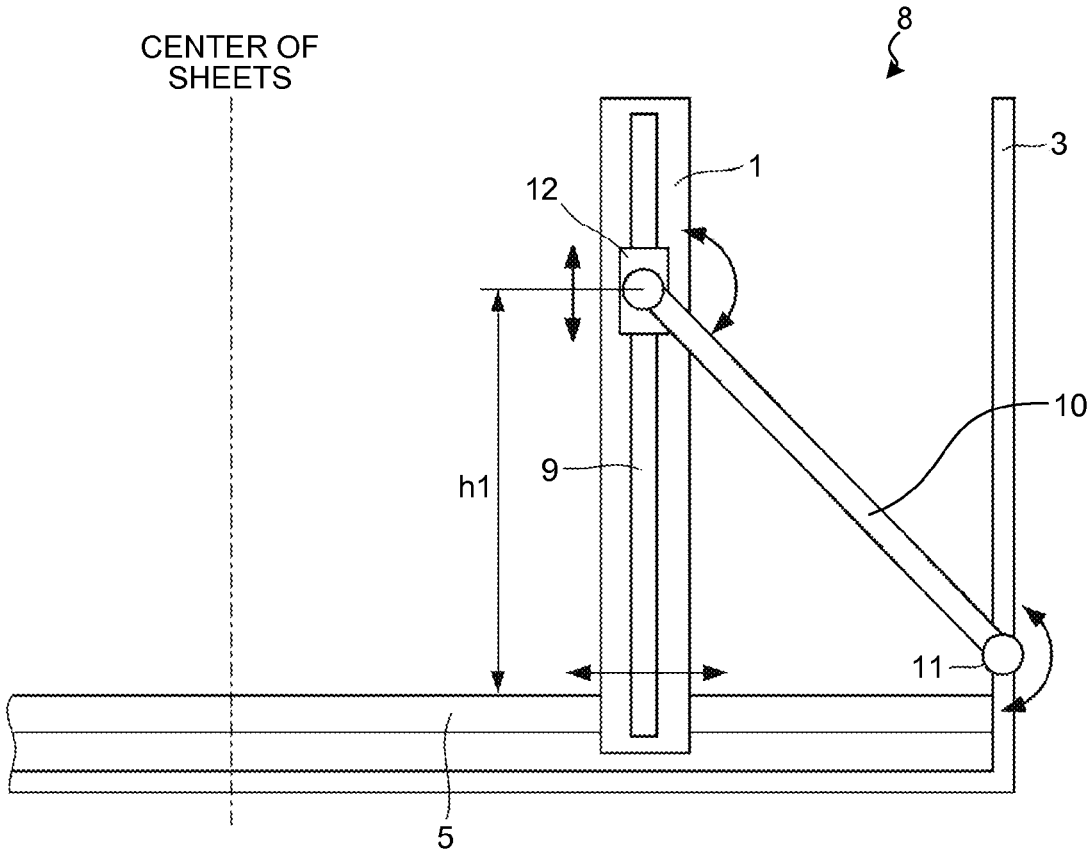
FIG. 3 is a cross-sectional view of the sheet feeder according to the embodiment in a state where a side fence is located inward (a schematic diagram of a sheet stacker as viewed in the direction of arrow A in FIG. 2)
Figure 4:
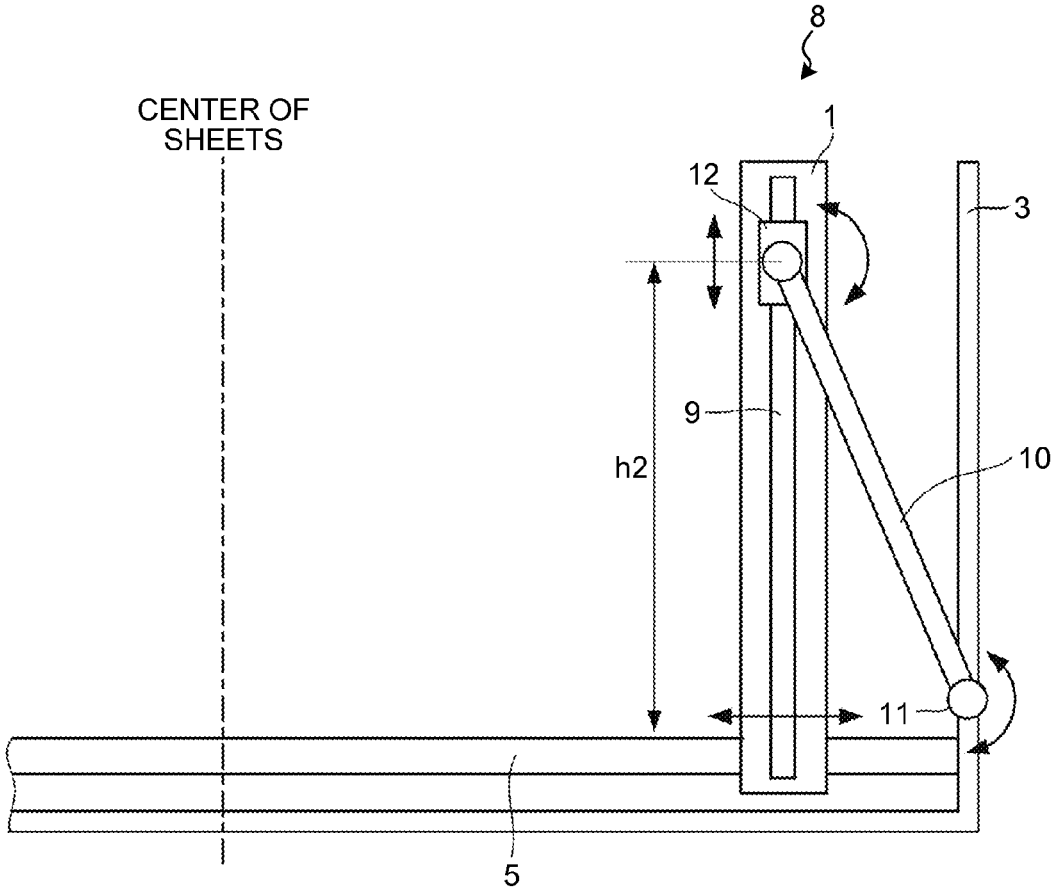
FIG. 4 is a cross-sectional view of the sheet feeder according to the embodiment in a state where the side fence is located outward to be opened.

As illustrated in FIGS. 3 and 4, each of the side fences 1 is movable along the guide shaft 5 between a state where the side fence 1 is located inward (see FIG. 3) and a state where the side fence 1 is located outward to be opened (see FIG. 4).

The side fence 1 includes a vertically-extending slide shaft 9. An anti-slide lock mechanism 12 that slides along the slide shaft 9 and can be locked/unlocked relative to the slide shaft 9 is fit onto the slide shaft 9 to be penetrated thereby.

A rod-like link member 10 is attached at a first end of the link member 10 to the anti-slide lock mechanism 12. The link member 10 is pivotable at the first end relative to the anti-slide lock mechanism 12. The link member 10 is attached at its second end, which is on a side opposite to the first end, to the sheet stacker 3 via a pivot point 11.

When the side fence 1 slides in the direction (direction in which the side fence 1 moves toward or away from a side wall of the sheet stacker 3) perpendicular to the sheet feeding direction along the guide shafts 5, the anti-slide lock mechanism 12 on the first end of the link member 10 slides upward or downward along the slide shaft 9 of the side fence 1 and, simultaneously, the link member 10 swings about the pivot point 11 at the second end of the link member 10. The pivot point 11 is arranged on the side wall of the sheet stacker 3 at a position lower than the first end (which is on the anti-slide lock mechanism 12) of the link member 10.

Figure 5:
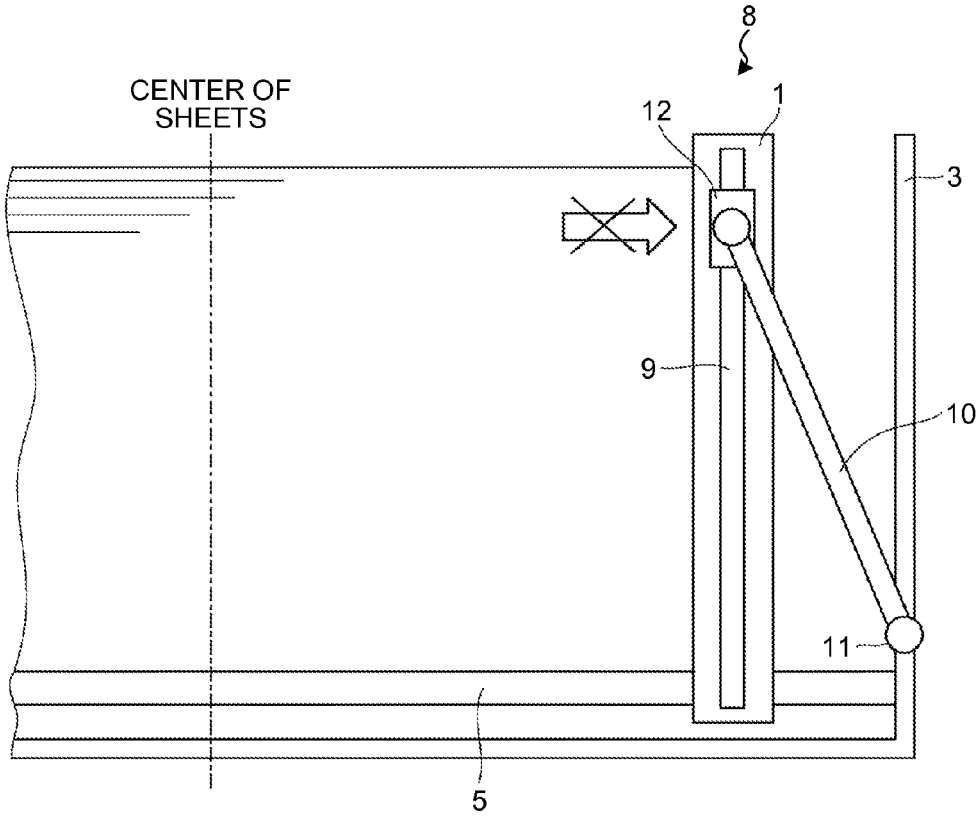
FIG. 5 is a cross-sectional view of the sheet feeder according to the embodiment in a state where the side fence is locked.

Locking the side fence 1 at a desired position is described below. Movement of the side fence 1 can be stopped by stopping movement of the link member 10, or, put another way, by putting the link member 10 in a non-swingable state as illustrated in FIG. 5.

In this way, the side fence 1 can be locked at a position near the top surface of the sheet stack from which the sheet is to be fed. Therefore, a clearance between the side fence 1 and the sheet is prevented, and occurrence of skew (oblique sheet feeding) or the like can be reduced.

A second feature is described below with reference to FIGS. 6 and 7.

Locking the side fence 1 at a desired position is performed by putting the link member 10 in the non-swingable state by locking the anti-slide lock mechanism 12 relative to the slide shaft 9.

Meanwhile, it is possible to put the link member 10 in the non-swingable state by fixing the pivot point 11 at the second end of the link member 10 as well. However, when the pivot point 11 unintentionally pivots minutely due to play or the like, the link member 10 is also swung. As a result, the side fence 1 is undesirably moved a large distance in the direction perpendicular to the sheet feeding direction.

Figure 6:
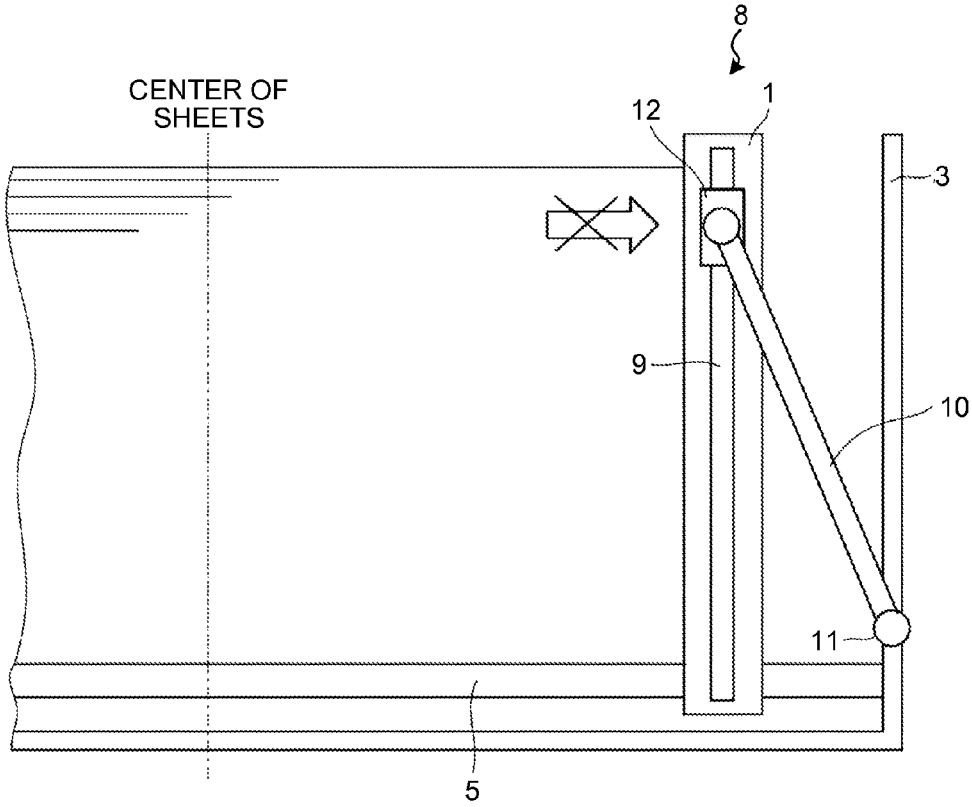
FIG. 6 is a cross-sectional view of the sheet feeder according to the embodiment in a state where the side fence is locked as a result that an anti-slide lock mechanism is locked.

In contrast, when the anti-slide lock mechanism 12 is locked relative to the slide shaft 9 as illustrated in FIG. 6, even if the anti-slide lock mechanism 12 is moved minutely due to play or the like, the movement of the anti-slide lock mechanism 12 is converted into minute vertical movement of the side fence 1. Accordingly, the side fence 1 is moved in the direction perpendicular to the sheet feeding direction only slightly, and a clearance will not be created between the side fence 1 and the sheet.

Figure 7:
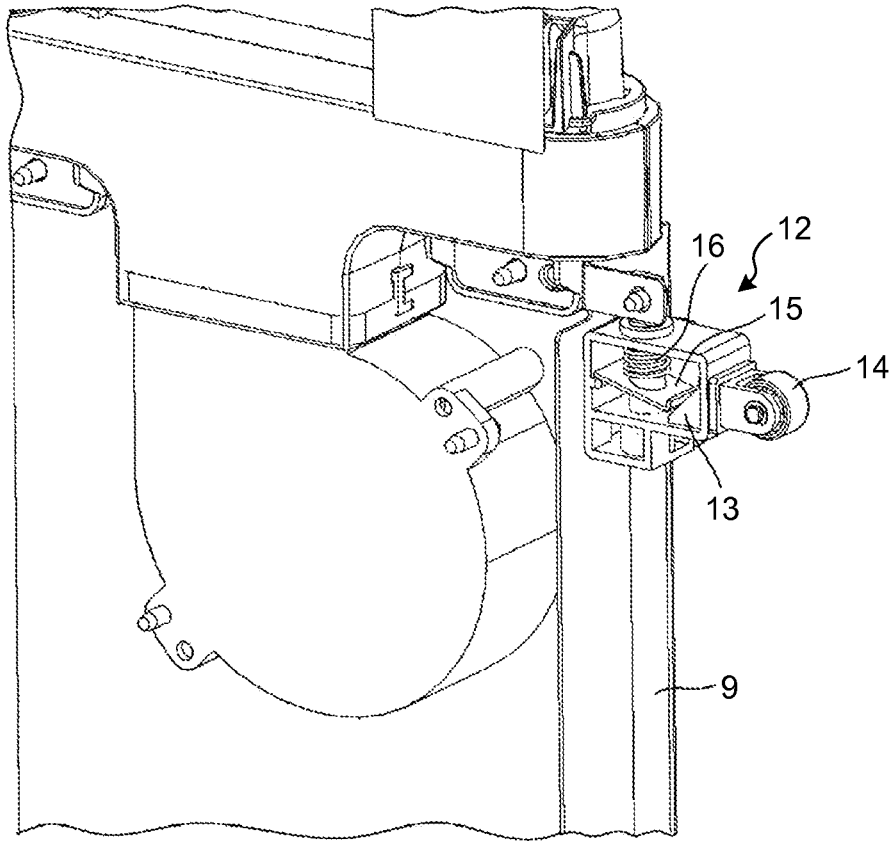
FIG. 7 is a perspective view illustrating the detailed configuration of the anti-slide lock mechanism of the sheet feeder according to the embodiment.

The anti-slide lock mechanism 12 can employ a locking coupling as illustrated in FIG. 7, for example, so as to be put in the locked state relative to the slide shaft 9. The anti-slide lock mechanism 12 may use another configuration for putting the anti-slide lock mechanism 12 in the locked state relative to the slide shaft 9.

A third feature is described below with reference to FIGS. 7 to 10.

As illustrated in FIG. 7, the anti-slide lock mechanism 12 includes a locking member 13 that locks/unlocks the anti-slide lock mechanism 12 relative to the slide shaft 9 and a free-rotating roller 14 arranged at a distal end of the locking member 13. The roller 14 is configured to be movable in one piece with the locking member 13.

The anti-slide lock mechanism 12 also includes a joint plate 15 that constitutes the locking coupling and a spring 16 that presses the joint plate 15. The anti-slide lock mechanism 12 is thus configured to be locked/unlocked using the locking coupling. The locking/unlocking of the anti-slide lock mechanism 12 is described in detail below with reference to FIGS. 8A and 8B.

Figure 8A:
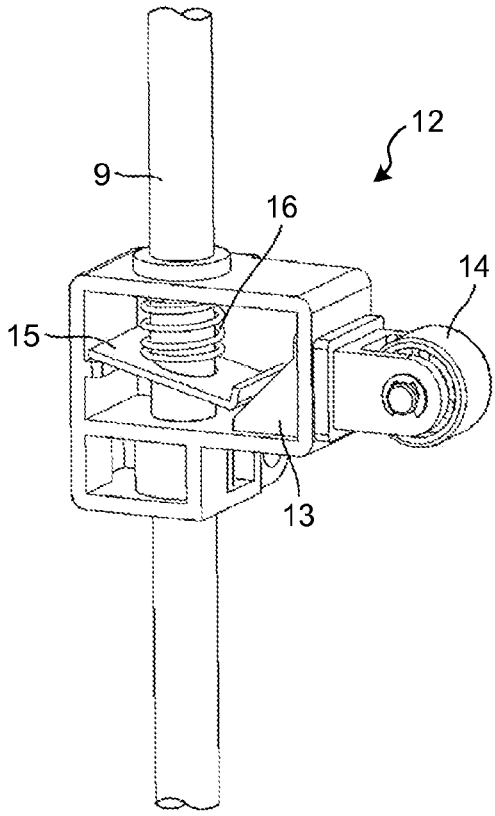
FIGS. 8A and 8B are perspective views of the anti-slide lock mechanism of the sheet feeder according to the embodiment, FIG. 8A illustrating the locked state, FIG. 8B illustrating an unlocked state.

FIG. 8A illustrates a state where the anti-slide lock mechanism 12 is locked relative to the slide shaft 9. In the locked state, the spring 16 presses the joint plate 15 constituting the locking coupling in the anti-slide lock mechanism 12. As being pressed, the joint plate 15 is tightly pressed against the slide shaft 9, thereby locking the anti-slide lock mechanism 12.

Figure 8B:
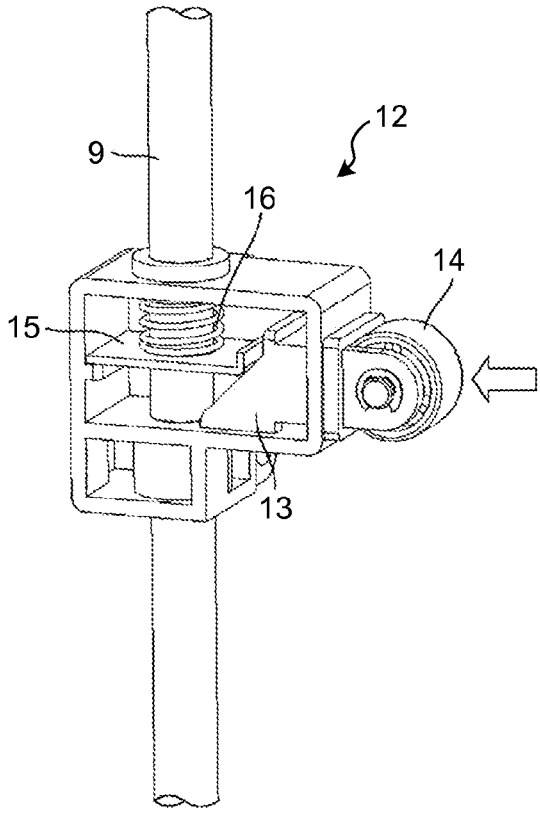

FIG. 8B illustrates a state where the anti-slide lock mechanism 12 is unlocked. This unlocked state is achieved as follows. When the roller 14 is pressed in, the locking member 13 slides to lift up the joint plate 15 out of the state where the joint plate 15 is tightly pressed against the slide shaft 9. As a result, the anti-slide lock mechanism 12 becomes to move freely.

Figure 9:
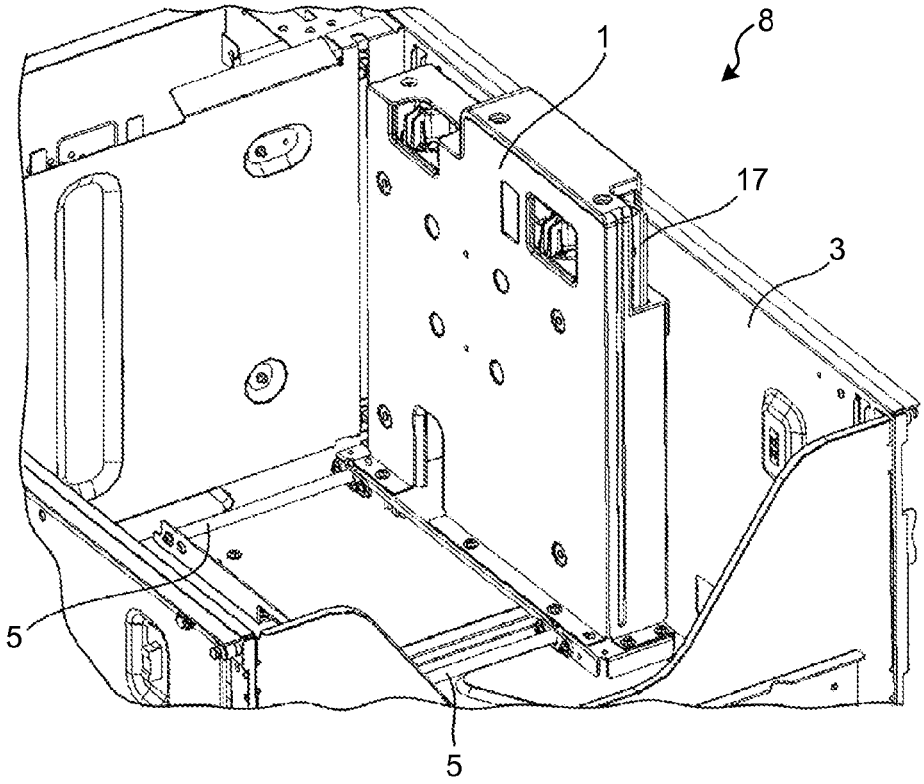
FIG. 9 is a perspective view of the sheet feeder according to the embodiment, in which the side fence includes a lever for controlling actuation of the anti-slide lock mechanism.
Figure 10:
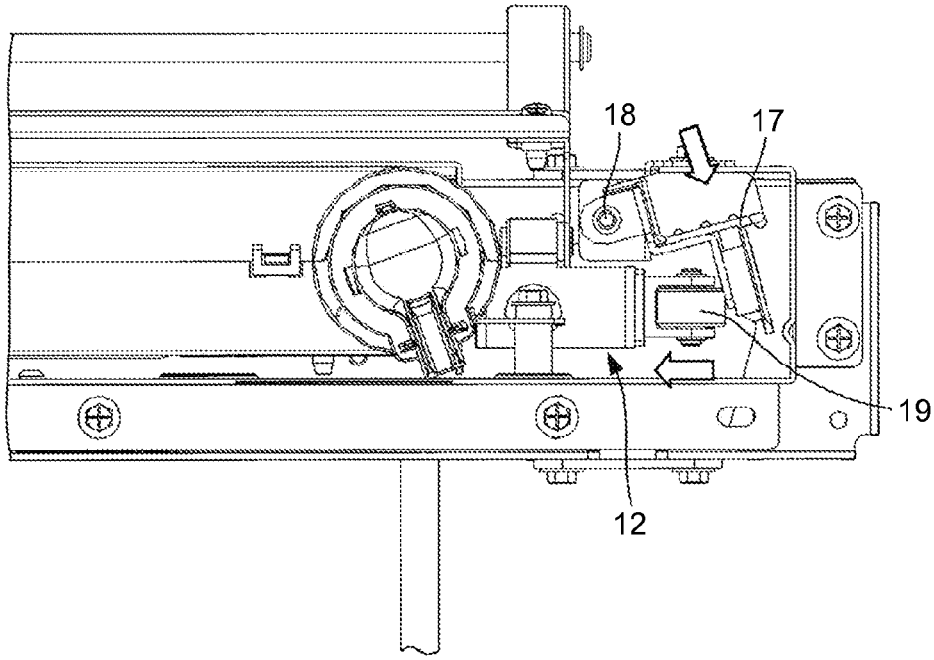
FIG. 10 is a cross-sectional view of the sheet feeder according to the embodiment in a state where the anti-slide lock mechanism is unlocked by lever operation.

As illustrated in FIG. 9, the side fence 1 includes a lever 17 that controls actuation (locking/unlocking) of the anti-slide lock mechanism 12. As illustrated in FIG. 10, the lever 17 is configured such that when the lever 17 is pressed by a user, the lever 17 pivots about a supporting point 18 to press a roller 19. Accordingly, when the lever 17 is operated, the roller 19 is pressed in, which causes the locking member 13 to lift up the joint plate 15 out of the state where the joint plate 15 is tightly pressed against the slide shaft 9. Consequently, the anti-slide lock mechanism 12 is unlocked, and the side fence 1 is put in a movable state.

When comparison is made between the state where the side fence 1 is located inward (see FIG. 3) and the state where the side fence 1 is located outward (see FIG. 4), h1, which is the height of the anti-slide lock mechanism 12 with reference to the guide shaft 5 in the state where the side fence 1 is located inward illustrated in FIG. 3, differs from h2, which is the height of the anti-slide lock mechanism 12 in the state where the side fence 1 is located outward illustrated in FIG. 4. Put another way, the height of the anti-slide lock mechanism 12 varies depending on the position of the side fence 1. The lever 17 is shaped to extend in the vertical direction. Accordingly, the roller 19 of the anti-slide lock mechanism 12 can be pressed by the lever 17 even when the anti-slide lock mechanism 12 is moved to a design upper end or a design lower end. Friction applied to the anti-slide lock mechanism 12 while the anti-slide lock mechanism 12 is moved up or down is reduced by the roller 19 that rotates in contact with the lever 17. Accordingly, such a situation that movement of the anti-slide lock mechanism 12 is hindered by the friction will not occur.

According to the present embodiment, a user can perform the operation for locking/unlocking the side fence 1 at a fixed position where the lever 17 is arranged without concerning which one of h1 illustrated in FIGS. 3 and h2 illustrated in FIG. 4 the height of the anti-slide lock mechanism 12 is. Accordingly, the user can perform the operation for locking/unlocking the side fence 1 by operating the lever 17 easily.

A fourth feature is described below with reference to FIG. 9.

As illustrated in FIG. 9, the lever 17 is arranged in an upper portion of the side fence 1. The lever 17 can be arranged at any height of the side fence 1 from a viewpoint of structure. However, arranging the lever 17 in the upper portion of the side fence 1 facilitates access to the lever 17 by a user and allows the user to operate the lever 17 easily when performing the operation for locking/unlocking the side fence 1.

A fifth feature is described below with reference to FIG. 11.

Figure 11:
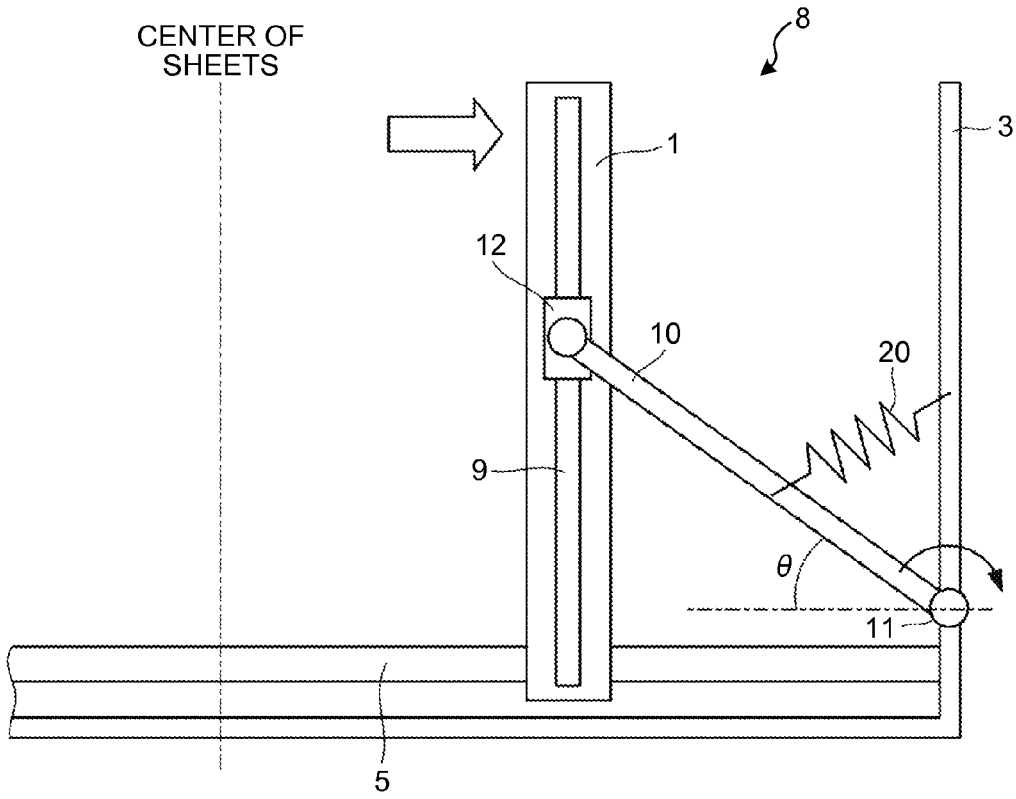
FIG. 11 is a cross-sectional view of a tension member of the sheet feeder according to the embodiment.

As illustrated in FIG. 11, as the side fence 1 moves inward toward the center of the sheets, the link member 10 tilts lower and lower, and θ, which is an angle of the link member 10 relative to the horizontal, decreases. When the angle θ is small, the link member 10 can undesirably act like an extendable tension rod and hinder movement of the side fence 1 when the side fence 1 is moved outward to be opened.

As a countermeasure against this problem, the sheet feeder 8 includes a tension member 20 that pulls the link member 10 outward (the side toward which the link member 10 is raised) so that a force is exerted in the direction in which the side fence 1 is opened. The tension member 20 is a tension spring that is connected at one end to the link member 10 and at the other end to the sheet stacker 3. Put another way, the tension member 20 exerts a force to the link member 10 in a direction (the direction in which the link member 10 is raised) in which the link member 10 swings when the side fence 1 moves toward the side wall of the sheet stacker 3.

This countermeasure allows the side fence 1 to move outward without receiving a resisting force from the link member 10 that can otherwise be applied to the side fence 1 when the side fence 1 is moved outward. Although FIG. 11 illustrates an example where the tension spring is used as the tension member 20, a similar effect can be obtained by arranging a torsion spring at the pivot point 11.

A sixth feature is described below with reference to FIGS. 12 to 14.

Figure 12:
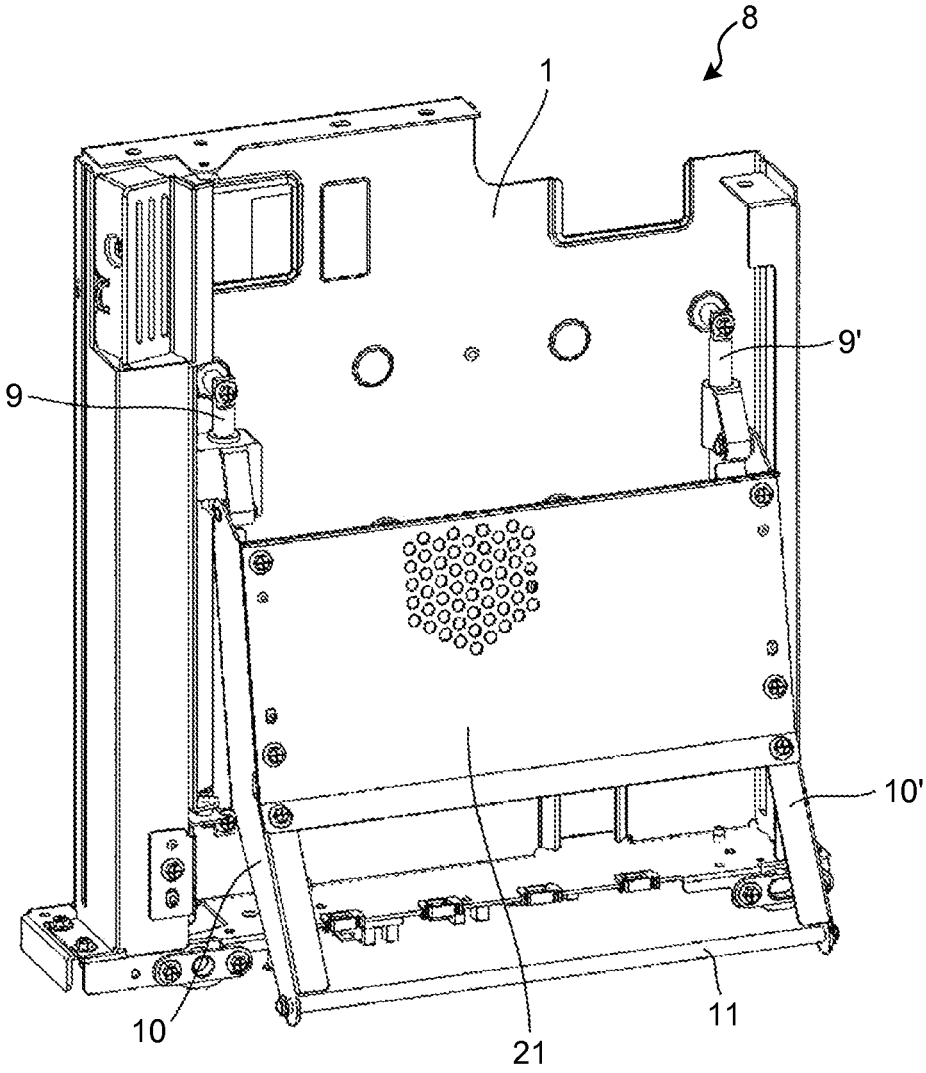
FIG. 12 is a perspective rear view of the side fence of the sheet feeder according to the embodiment.
Figure 14:
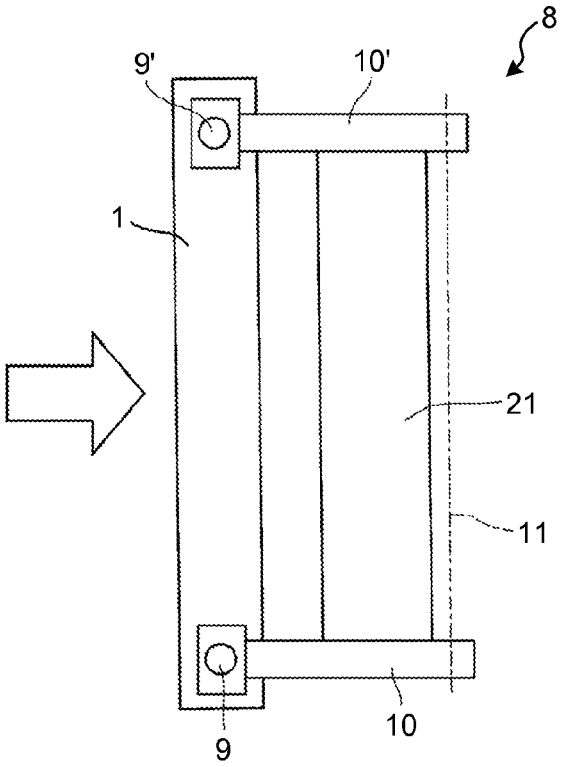
FIG. 14 is a top view of the side fence of the sheet feeder according to the embodiment in which linkages are arranged on both ends of the side fence.

As illustrated in FIGS. 12 and 14, the sheet feeder 8 includes a slide shaft 9' and a link member 10' that are similar in configuration to the slide shaft 9 and the link member 10, respectively, in a second area of the side fence 1 which is at a location different from a location of a first area where the slide shaft 9 and the link member 10 are provided.

Put another way, the sheet feeder 8 includes a first linkage made up of the slide shaft 9 and the link member 10 in the first area of the side fence 1 and a second linkage made up of the slide shaft 9' and the link member 10' in the second area of the side fence 1. The link member 10 and the link member 10' are connected by a connecting plate 21 which is a rigid member.

Figure 13:
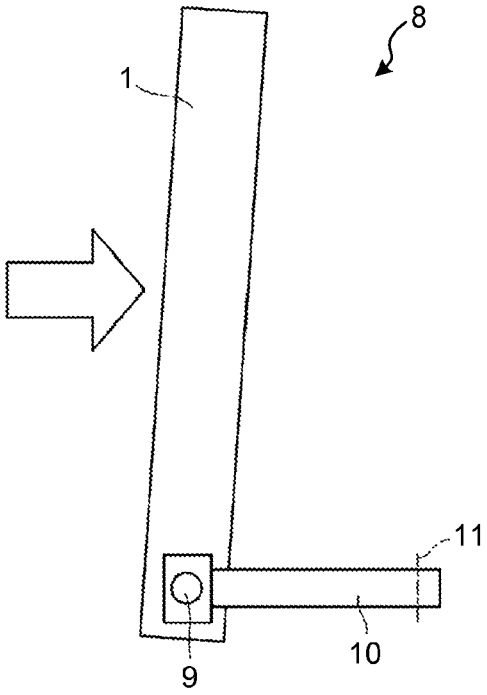
FIG. 13 is a top view of the side fence of the sheet feeder according to the embodiment.

Assume that only one of the linkages is attached to the side fence 1 as illustrated in FIG. 13, or, in other words, the side fence 1 includes only the first linkage made up of the slide shaft 9 and the link member 10. In such a case, when a force is exerted onto the side fence 1 in the direction in which the side fence 1 is opened, the side fence 1 is undesirably twisted about the slide shaft 9. When the side fence 1 is twisted, a clearance is undesirably created between the side fence 1 and the sheet, and skew or the like can occur.

However, in the configuration illustrated in FIGS. 12 and 14, the linkages are arranged on the both ends of the side fence 1 and the connecting plate 21 connects across the link member 10 and the link member 10'. Accordingly, the side fence 1 is prevented from being twisted irrespective of the rigidity of the side fence 1 even when a force is exerted to the side fence 1 in the direction in which the side fence 1 is opened.

A seventh feature is described below with reference to FIG. 2.

As illustrated in FIG. 2, the side fences 1 are arranged in the sheet feeder 8 on the both sides of the sheets to be equidistant from the center of the sheets. The linkages are also arranged on the both sides to be equidistant from the center of the sheets. Put another way, the sheet feeder 8 includes the side fence 1 and the linkage (the slide shaft 9 and the link member 10) on one side of the sheets, and the side fence 1 and the linkage (the slide shaft 9' and the link member 10') on the other side of the sheets to be equidistant from the center of the sheets.

This makes it possible to provide the sheet feeder 8 of high quality capable of regulating the both side ends of the sheets to inside the side fences 1 reliably and free from skewing.

An eighth feature is described below with reference to FIG. 15.

Figure 15:
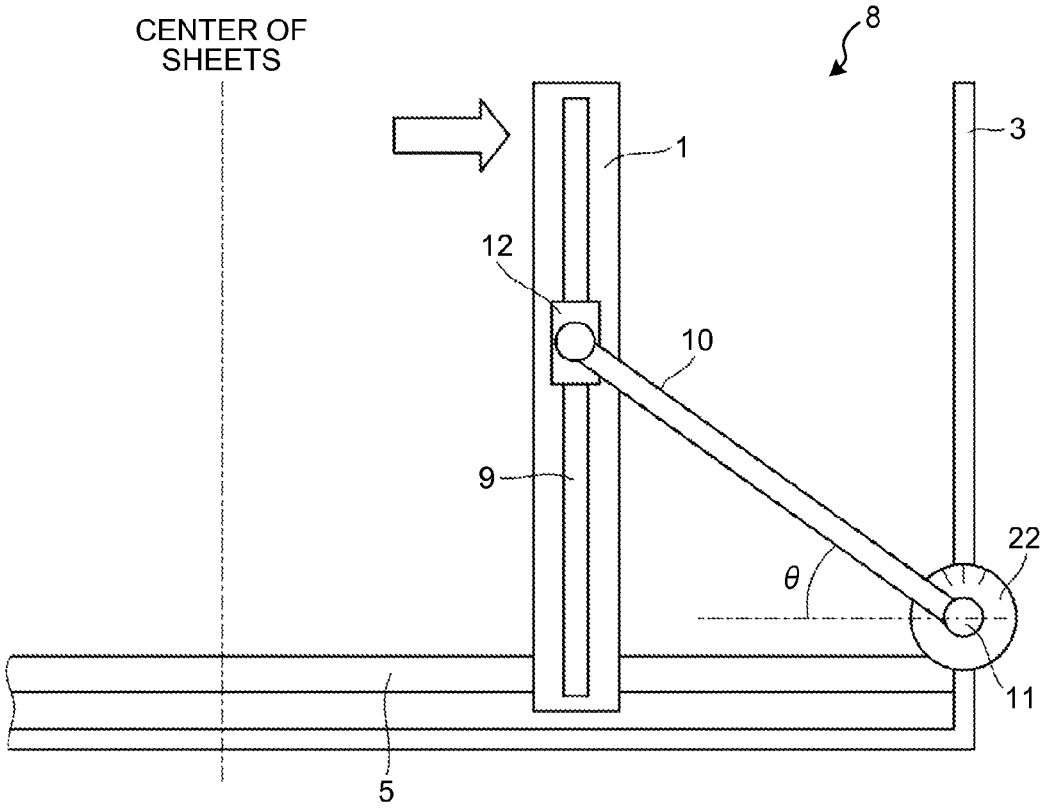
FIG. 15 is a cross-sectional view of the sheet feeder according to the embodiment that includes a size detection mechanism that detects a sheet width by detecting an angle of a link member.
Figure 16:
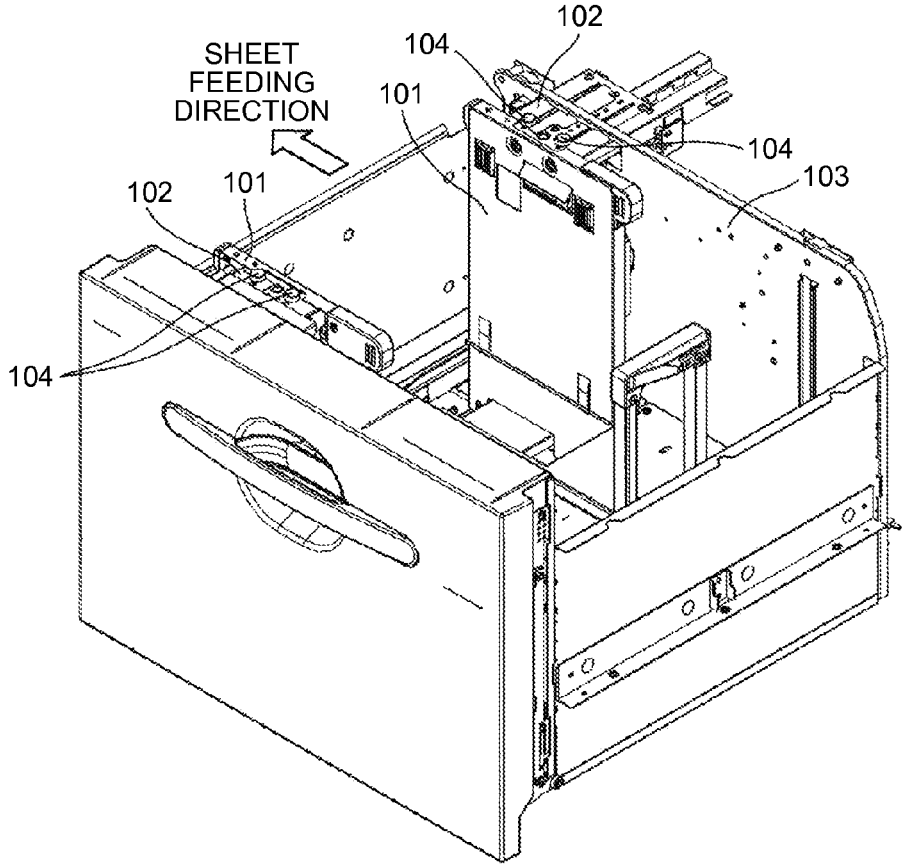
FIG. 16 is a perspective view of a conventional sheet feeder.
Figure 17:
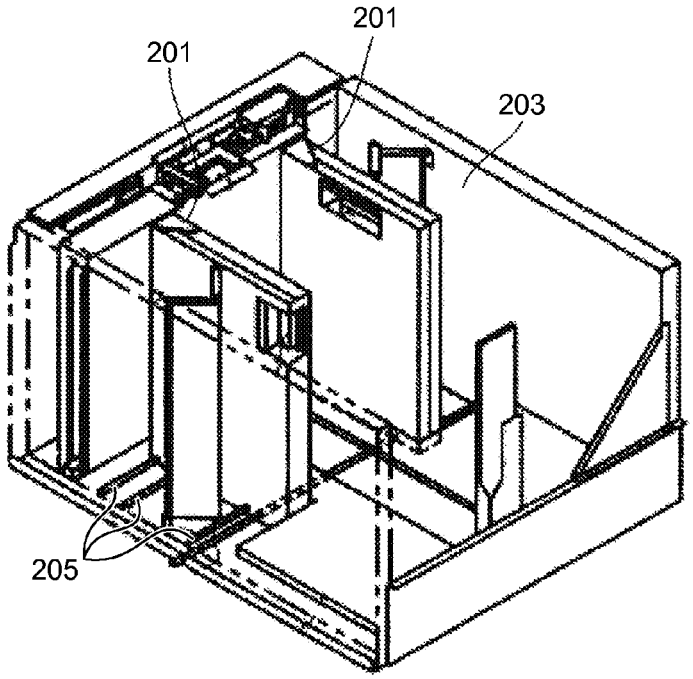
FIG. 17 is a perspective view of another conventional sheet feeder.

As illustrated in FIG. 15, the sheet feeder 8 includes a size detection mechanism 22 that detects the width of the sheets by detecting the angle of the link member 10.

Accordingly, the sheet feeder 8 can detect the width of the sheets with the compact and less expensive structure without a mechanism, which is used in conventional sheet feeders, for detecting a sheet size using a feeler or the like which is an additional component arranged on the side fence.

A ninth feature is described below.

The image forming system 6 includes the sheet feeder 8 that includes the first to eighth features described above. Accordingly, the image forming system 6 can properly regulate the side ends of the sheets to inside the side fences 1 irrespective of rigidity of the side fences 1 without troubling a user when the user sets the side fences 1. Therefore, usability quality of the image forming system 6 as equipment is enhanced.

As described above, the sheet feeder 8 according to the present embodiment includes the slide shafts 9 each of which is arranged in one of the side fences 1 and extends in the vertical direction, the link members 10 each of which is slidable at the first end along the slide shaft 9 and pivotable at the second end about the pivot point 11 that is on the side wall of the sheet stacker 3 at the position lower than the first end and swings as the side fences 1 move toward or away from the side walls of the sheet stacker 3, and the anti-slide lock mechanisms 12 each of which corresponds to a swing stopper unit that stops swing of the link member 10.

According to this configuration, the anti-slide lock mechanism 12 corresponding to the swing stopper unit stops swing of the link member 10. As a result, the side fence 1 is locked, and the first end of the link member 10 laterally supports the side fence 1 near the top surface of the sheet stack from which the sheet is to be fed. Accordingly, a clearance is not created between the side fence 1 and the sheet, and occurrence of skew or the like is reduced. Thus, the side ends of the sheets can be properly regulated to inside the side fences 1.

In the sheet feeder 8 according to the embodiment, the swing stopper unit is preferably the anti-slide lock mechanism 12 arranged at the first end of the link member 10 to lock the first end of the link member 10 relative to the slide shaft 9. The swing of the link member 10 is stopped by putting the anti-slide lock mechanism 12 in the locked state.

According to this configuration, the swing of the link member 10 is stopped by putting the anti-slide lock mechanism 12 in the locked state. Accordingly, even if the anti-slide lock mechanism 12 is moved minutely due to play or the like, the movement of the anti-slide lock mechanism 12 is converted into minute vertical movement of the side fence 1. As a result, the side fence 1 is moved in the direction perpendicular to the sheet feeding direction only minutely, and a clearance between the side fence 1 and the sheet is prevented.

In the sheet feeder 8 according to the embodiment, the side fence 1 preferably includes the lever 17 to be operated to put the anti-slide lock mechanism 12 in any one of the locked state and the unlocked state. The anti-slide lock mechanism 12 preferably includes the spring 16, the roller 14 to be pressed by the lever 17 when the lever 17 is operated, and the joint plate 15 that makes pressure contact with the slide shaft 9 when pressed by the spring 16 and is released from the pressure contact with the slide shaft 9 when pressed by the roller 14.

According to this configuration, a user can perform the operation for locking/unlocking the side fence 1 at the fixed position where the lever 17 is arranged every time. Accordingly, the user can perform the operation for locking/unlocking the side fence 1 by operating the lever 17 easily without concerning the height of the anti-slide lock mechanism 12.

In the sheet feeder 8 according to the embodiment, the lever 17 is preferably arranged in the upper portion of the side fence 1.

According to this configuration, the lever 17 is arranged in the upper portion of the side fence 1 where the lever 17 can be operated easily. Accordingly, a user can perform the operation for locking/unlocking the side fence 1 easily by operating the lever 17.

In the sheet feeder 8 according to the present embodiment, the side fence 1 preferably includes the tension member 20 that exerts a force to the link member 10 in the direction in which the link member 10 swings when the side fence 1 moves toward the side wall of the sheet stacker 3.

According to this configuration, the tension member 20 exerts a force to the link member 10 in the direction in which the side fence 1 is opened. Accordingly, it is possible to move the side fence 1 outward without receiving a resisting force from the link member 10 that can otherwise be applied to the side fence 1 when the side fence 1 is moved outward to be opened.

The sheet feeder 8 according to the present embodiment preferably includes two sets of the slide shafts 9 and the link members 10, each set containing the slide shaft 9 and the link member 10, arranged on the side fence 1 at different positions in the sheet feeding direction, and the connecting plate 21 that connects across the two link members 10 and 10'.

According to this configuration, the two link members, which are the link members 10 and 10', are arranged on the side fence 1, and the connecting plate 21 connects across these link members 10 and 10'. Accordingly, the side fence 1 will not be twisted irrespective of rigidity of the side fence 1.

In the sheet feeder 8 according to the embodiment, the side fence 1 is preferably arranged on each side with respect to the direction that is perpendicular to the sheet feeding direction to regulate the both side ends of the sheets to inside the side fences 1.

According to this configuration, the side fences 1 are arranged on the both sides with respect to the direction perpendicular to the sheet feeding direction. Accordingly, the sheet feeder 8 of high quality capable of regulating the both side ends of the sheets to inside the side fences 1 reliably and free from skewing can be provided.

In the sheet feeder 8 according to the embodiment, the link member 10 preferably includes the size detection mechanism 22 that detects the width of the sheets by detecting the angle of the link member 10 at the pivot point 11 and is assembled into the link member 10.

According to this configuration, the size detection mechanism 22 is assembled into the link member 10. Accordingly, the sheet feeder 8 can detect the width of the sheets with the compact and less expensive structure without a mechanism, which is used in conventional sheet feeders, for detecting a sheet size using a feeler or the like which is an additional component arranged on the side fence 1.

The image forming system 6 according to the present embodiment includes the sheet feeder 8 described above.

According to this configuration, the image forming system 6 can properly regulate the side ends of the sheets to inside the side fences 1. As a result, usability quality of the image forming system 6 as equipment is enhanced.

According to an aspect of the present embodiments, a sheet feeder capable of properly regulating side ends of sheets within a given range and an image forming system are provided.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet feeder for feeding sheets from a sheet stack containing a plurality of sheets one sheet by one sheet in a sheet feeding direction, the one sheet being an uppermost sheet of the sheet stack, the sheet feeder comprising:

a sheet stacker for accommodating the sheet stack therein;

a side fence arranged inside the sheet stacker to regulate side ends of the sheets and movable in a direction perpendicular to the sheet feeding direction;

a slide shaft arranged in the side fence and extending in a vertical direction;

a link member that swings as the side fence moves, a first end of the link member configured to be slidable along the slide shaft, and a second end of the link member configured to be pivotable about a pivot point, which is arranged on a side wall of the sheet stacker at a position lower than the first end; and a swing stopper unit to stop swinging of the link member, wherein the swing stopper unit is an anti-slide lock mechanism arranged at the first end of the link member to lock the first end of the link member relative to the slide shaft when in a locked state, and wherein swinging of the link member is stopped when the anti-slide lock mechanism is in a locked state.

2. The sheet feeder according to claim 1, wherein the side fence includes a lever to be operated to put the anti-slide lock mechanism in any one of the locked state and an unlocked state, and the anti-slide lock mechanism includes a roller to be pressed by the lever when the lever is operated, and a joint plate to make pressure contact with the slide shaft when pressed by a spring, the joint plate being released from the pressure contact with the slide shaft when pressed by the roller.

3. The sheet feeder according to claim 2, wherein the lever is arranged in an upper portion of the side fence.

4. The sheet feeder according to claim 3, wherein the side fence includes a swing assist unit that exerts a force to the link member in a direction in which the link member swings when the side fence moves toward the side wall of the sheet stacker.

5. The sheet feeder according to claim 1, further comprising a connecting member, wherein two sets of the slide shafts and the link members, each set containing the slide shaft and the link member, are arranged on the side fence at different positions in the sheet feeding direction, and the connecting member connects across the link members of the two sets.

6. The sheet feeder according to claim 5, wherein the side fence is arranged on each side with respect to the direction that is perpendicular to the sheet feeding direction to regulate both side ends of the sheets.

7. The sheet feeder according to claim 1, wherein the link member includes a size detection mechanism that detects a width of the sheets by detecting an angle of the link member at the pivot point, the size detection mechanism being assembled into the link member.

8. An image forming system comprising a sheet feeder for feeding sheets from a sheet stack containing a plurality of sheets one sheet by one sheet in a sheet feeding direction, the one sheet being an uppermost sheet of the sheet stack, the sheet feeder comprising:

a sheet stacker for accommodating the sheet stack therein;

a side fence arranged inside the sheet stacker to regulate side ends of the sheets and movable in a direction perpendicular to the sheet feeding direction;

a slide shaft arranged in the side fence and extending in a vertical direction;

a link member that swings as the side fence moves, a first end of the link member configured to be slidable along the slide shaft, and a second end of the link member configured to be pivotable about a pivot point, which is arranged on a side wall of the sheet stacker at a position lower than the first end; and a swing stopper unit to stop swinging of the link member, wherein the swing stopper unit is an anti-slide lock mechanism arranged at the first end of the link member to lock the first end of the link member relative to the slide shaft when in a locked state, and wherein swinging of the link member is stopped when the anti-slide lock mechanism is in a locked state.

* * * * *